United States Patent [19]

Bailly du Bois

[11] 4,285,202

[45] Aug. 25, 1981

[54] METHOD OF ENERGY CONVERSION AND A DEVICE FOR THE APPLICATION OF SAID METHOD

[76] Inventor: Bernard Bailly du Bois, 58 rue de Maubeuge, 75000 Paris, France

[21] Appl. No.: 951,943

[22] Filed: Oct. 16, 1978

[51] Int. Cl.[3] ..... F01K 25/06; F02C 1/04

[52] U.S. Cl. ..... 60/650; 62/499

[58] Field of Search ..... 60/650, 669, 671, 682, 60/721; 165/104 M; 252/67; 62/499, 401

[56] References Cited

U.S. PATENT DOCUMENTS

| | | | |
|---|---|---|---|
| 2,690,051 | 9/1954 | Peskin | 60/682 |
| 2,924,081 | 2/1960 | Justice | 62/499 |
| 3,931,713 | 1/1976 | Eskeli | 60/650 |
| 4,010,018 | 3/1977 | Kantor | 62/499 |

*Primary Examiner*—James J. Gill

*Attorney, Agent, or Firm*—Sprung, Felfe, Horn, Lynch & Kramer

[57] ABSTRACT

The utilizable energy of a working fluid is converted into mechanical energy by means of friction forces exerted by the fluid on the moving walls of one or a number of circulation ducts forming part of a rotor. In their respective azimuthal projections, the friction force exerted on the fluid by the duct walls and the Coriolis force to which the fluid is subjected are of the same order of magnitude. The method consists in varying the pressure of the working fluid which is circulated in a spiral circuit and subjected to azimuthal displacements in the same direction of rotation as the rotor when the fluid comes closer to the axis and in the opposite direction when it moves away from the axis. When at least a portion of the duct walls forms part of a heat exchanger, the working fluid can also undergo predetermined variations in entropy and in enthalpy.

13 Claims, 7 Drawing Figures

METHOD OF ENERGY CONVERSION AND A DEVICE FOR THE APPLICATION OF SAID METHOD

This invention relates to industrial processes for energy conversion involving at least one step which consists in acting on the presence of a working fluid in such a manner as to produce either compression or expansion. Potential applications includes machines in which the working fluid flows in a closed circuit and performs a complete thermodynamic cycle.

It is already a known practice to subject a working fluid to a thermodynamic cycle within a rotor which is driven in rotation about a stationary axis. In one known type of rotating machine which can be mentioned in particular, the working fluid flows between a hot source and a cold source, the circulation of fluid between these sources being so arranged as to make advantageous use of centrifugal force, thus permitting compression of the fluid when it moves away from the axis of rotation and expansion of the fluid when it moves towards the axis. Rotating boilers or condensers are also known in which the effects of centrifugal force are utilized during the change of phase of the fluid in order to assist the separation of the liquid and vapor phases.

The known arrangements of these machines and devices can also be used to advantage in the application of the present invention and in connection with a certain number of preferred embodiments. In fact, such arrangements are usually compatible with the essential features of the invention, namely those relating to the circulation of the working fluid, the nature of this latter and the operating conditions in any rotating machine in which the working fluid undergoes either compression or expansion within a rotor, at least in one operational step. The invention therefore applies to any method or device for producing or absorbing mechanical or thermal energy in response to a variation in the characteristics of the working fluid. When there is no heat transfer with the exterior, because will be had more specifically to pumps and compressors in the case of compression of the working fluid and to turbines in the case of expansion. However, the invention also applies to heat engines and heat pumps, in which case compression or expansion is combined with heat transfer between the rotor and the exterior. In a general manner, the thermodynamic cycle followed by the fluid can be either open or closed and it is often advantageous to ensure that a number of its stages take place within the same rotor.

In a first embodiment, the invention essentially consists in utilizing the friction forces developed between the fluid and the guiding walls with which it is in contact by causing the work produced by the displacement of these forces to play an important part in the pressure variations of the fluid along the circuit in the direction of either compression or expansion of said fluid, said pressure variations being also related to the gravitational field produced by the rotation.

In the devices and machines which are contemplated for the practical application of the method in accordance with the invention, the working fluid circulates within a duct and especially a circular duct having walls rigidly fixed to a rotor which is capable of moving in rotation about a stationary axis. This duct determines within the rotor a variable azimuth circuit about the axis of rotation. The designation "variable azimuth circuit" applies here and throughout the following description to circuits having the general shape of a spiral. In other words, the successive points of the various stream lines constituting a fluid circuit are located in respective meridian planes whose azimuth varies in a predetermined direction; at the same time, these successive points are located at radial distances which vary in a predetermined direction in respect to positions which may also vary in the axial direction. This designation includes the particular cases of spirals contained in a plane at right angles to the axis of rotation such as Archimedes' spirals in which the distance from the axis varies proportionally to the azimuth angle, or logarithmic spirals in which the angle made with the radial direction by the directional vector remains constant.

In accordance with the invention, the working fluid duct which is rigidly fixed to the rotor draws progressively nearer to the axis of rotation as the duct is followed by turning around said axis with respect to the rotor and in the direction of rotation of this latter (the duct therefore draws progressively away from the axis as it is followed by turning in the opposite direction). In other words, the working fluid circulates within the rotor inside a spiral-shaped duct which ensures that the relative azimuthal displacements of the fluid with respect to the rotor take place in the same direction along the entire circuit. Said spiral duct is oriented in such a manner that the fluid draws closer to the axis if it rotates in the same direction as the rotor in a movement of relative displacement with respect to this latter and draws away from the rotor if it rotates in the opposite direction. The geometrical orientation of the spiral is consequently dependent on the direction of rotation of the rotor but is not dependent on the direction of flow of the fluid within its duct. It will be readily apparent that a single rotor can have several ducts or even a large number of similar ducts in series and/or in parallel with the working fluid circuit.

In accordance with the invention, the geometrical characteristics of the working fluid duct and the operating conditions are also determined in conjunction with each other so that, in their respective azimuthal projections (these projections being orthogonal to the direction which is perpendicular to the meridian plane), the friction force exerted by the duct wall on the fluid and the Coriolis force are of the same order of magnitude.

The invention also makes it possible to prevent local variations in pressure and therefore in velocity of the fluid and the resultant degradations of energy in conventional machines, or at least to reduce them to an appreciable extent. To this end, the invention utilizes in combination two classes for forces for producing action on the fluid and constituting the azimuthal projection of Coriolis forces induced by reason of the relative flow of fluid with respect to the rotor, namely the friction forces exerted in a direction parallel to the surface of the walls and pressure forces which are exerted in a direction at right angles to said surface and are the only forces which perform a useful function in the blade systems of conventional machines.

In practice, the advantages of the invention are obtained if the ratio of the azimuthal projection of the friction force and the azimuthal projection of the Coriolis force at each point of the duct is within the range of 0.2 to 2 and if the geometry of the duct is determined in such a manner as to satisfy this condition throughout the length of the circuit and over the entire range of rates of flow of fluid and speeds of the rotor during operation. By way of comparison, this ratio would remain lower than 0.1 or at a maximum of the order of this value by reason of the effort made to reduce friction forces in conventional machines.

The determination of friction forces and of Coriolis forces by means of conventional equations involves the angular velocity $\omega$ of the rotor, the relative velocity V of the fluid with respect to the rotor, the hydraulic diameter D of the duct, the coefficient of friction f of the fluid on the walls of the duct and the angle A between the meridian plane and the plane which is parallel to the axis of the rotor and to the direction defined by the duct at the point considered. The condition referred-to above is accordingly expressed by the relation:

$$0.2 \leqq (fV/\omega D)\mathrm{tg}A \leqq 2$$

In order to gain a clearer understanding, reference will now be made to FIG. 1 of the accompanying drawings in which T designates the path of a duct assumed to be located in a plane at right angles to the axis within a rotor having the axis O and designated to rotate in the direction of the arrow $\omega$, V designates the relative velocity, with respect to the rotor, of a fluid being compressed within the duct, C designates the Coriolis force, F designates the friction force; the projections of these forces in the azimuthal direction X—X' (orthogonal projections) are represented.

When the condition in accordance with the invention is satisfied, the relative velocity V retains an approximately uniform value locally in respect of points which are located within the fluid in the vicinity of the walls and at a given distance R from the axis of rotation. The coefficient f is determined by means of the relation $dp/ds = 2f\rho\ (V^2/D)$, where dp/ds is the pressure drop per unit length of duct as measured when the rotor is motionless and when a fluid having a density $\rho$ is passed through the duct at a mean velocity $\overline{V}$. The hydraulic diameter D of the duct is equal to four times the ratio between its transverse cross-section and the corresponding perimeter on the wall.

Moreover, the compression and expansion efficiencies are higher as the slippage of the fluid with respect to the rotor is of smaller value; to this end, it is an advantage to limit the ratio $V/\omega R$ to a value which may be either slightly or considerably lower than 0.2.

In certain embodiments of the invention, it proves an advantage to combine the mechanical effects with additions or withdrawals of heat performed by means of the friction surfaces constituted by the duct walls. This duct is accordingly employed as a heat exchanger which can constitute either a heat source or a heat sink in a thermodynamic cycle followed by the working fluid. Heat can be supplied to the exchanger or withdrawn therefrom by means of an auxiliary fluid located on the other side of tubular walls which define the working fluid duct. In general, said auxiliary fluid advantageously circulates in spiral circuits which are parallel to those of the working fluid, in the same direction as said fluid or in the opposite direction. By way of alternative, the heat can be produced or absorbed directly within the fluid in that zone of the circuit which constitutes the heat source or heat sink.

When the spiral duct in which the fluid circulates during compression or expansion constitutes a heat exchanger, the invention makes it possible by preventing local variations in velocity of the fluid at a given distance from the axis, to overcome at the same time the disadvantages attached to local variations in temperature difference between the fluid and the duct walls.

When the duct is employed as a heat exchanger, the Reynolds analogy implies that the Stanton number is very close to the coefficient f/2. In order to obtain uniformity of wall temperatures at a given distance from the axis in accordance with the invention, one method of satisfying the condition mentioned earlier consists in ensuring that the quantity of heat exchanged with the fluid while the rotor moves through one radian is within the range of 0.4 times to 4 times the product of the cotangent of the angle A and of the heat capacity per degree and at constant pressure of the fluid contained within the portion of circuit under consideration, multiplied by the mean temperature difference between the fluid and the wall.

When the flow is turbulent, the coefficient f is practically invariable throughout the range of operation of the device; in this case the condition imposed in accordance with the invention implies that substantial variations in rate of flow of the fluid are accompanied by variations in the speed of rotation $\omega$ in the same direction.

When the flow is laminar, the quantity fVD is proportional to the kinematic viscosity of the fluid $\mu/\rho$. The condition imposed then makes it necessary to establish between two numerical limits the number $\rho\omega D^2/\mu\mathrm{tg}A$ in respect to the speeds $\omega$ of utilization of the device. For example, if the duct is materialized by parallel discs separated by a distance D/2, the number thus defined can be chosen so as to remain within the range of 5 to 50 and preferably in the vicinity of 25.

So far as the angle A is concerned, the best theoretical performances for the specific power are usually obtained when this angle has a constant value between 30 and 45 degrees, in which case the ducts have the shape of logarithmic spirals. However, the constructional problems arising from the need for small hydraulic diameters very often make it preferable, especially in the case of the heat exchangers and turbulent flow, to make use of relative flow paths having the shape of Archimedean spirals with angles A which are greater than 60 degrees or very slightly smaller than 90 degrees and in practice up to 89 degrees.

The cross-section of the duct can have any desired shape. The duct walls are usually provided with fins or corrugations which make it possible in particular to vary the hydraulic diameter of the flow and the relative velocity V as a function of the distance R from the axis.

In regard to the general arrangement of the ducts, three main configurations can be adopted: juxtaposition of stacked discs which are perpendicular to the axis, the ducts being delimited in the radial direction by spiral ribs which are integral with the discs; rows of tubes coiled in radial spirals and joined to collector tubes of larger diameter which are parallel to the axis of the rotor; ribbed plates of substantial width placed around the axis in much the same manner as a roll of carpet. However, the invention is not limited to these configurations since they are only the most simple examples.

Another distinctive feature of the invention can be employed advantageously but not necessarily in conjunction with the geometrical and functional conditions set forth in the foregoing and can generally be applied to any method of conversion of energy in which a working fluid is circulated within a rotor and follows a thermodynamic cycle with exchange of mechanical or thermal energy between the rotor and the exterior. In accordance with this distinctive feature, the working fluid is constituted by a gas having a low value of specific heat and a molecular weight which is preferably at least equal to that of nitrogen, there being present in suspension in said gas submicronic particles of a substance having a high atomic weight.

This solution has the advantage to concilate the requirements of low specific heat and high atomic weight which are desirable for the purpose of increasing the temperature difference between heat source and heat sink in respect of a given peripheral velocity of the rotor (or conversely in order to reduce the speed of rotation) without having recourse to heavy gases such as mercury vapor, the use of which is not always possible for reasons of chemical corrosion or toxicity. However, the dimensions of the particles which are of the order of one micron at a maximum are sufficiently small to ensure uniformity of temperature within the fluid and to ensure that their rate of slippage within the gas remains negligible in a high gravitational potential.

The carrier gas advantageously consists of nitrogen or a monoatomic gas having an atomic weight which is higher than the molecular weight of nitrogen. This gas preferably consists of argon or krypton or possibly of xenon.

The particles can be constituted by chemical elements in the solid phase of standard commercial purity having an atomic weight higher than 90 and preferably consisting of tungsten, lead, bismuth, thorium or uranium. These particles can be coated with a thin film of a compound formed by said chemical elements and preferably consisting of an oxide in a monomolecular layer or of any dispersive material having the primary aim of neutralizing Van der Vals forces.

The diameter of these particles is advantageously limited on an average to a maximum of 0.1 micron and preferably within the range of 0.001 to 0.1 micron; the specific surface area of the powder than formed is greater than 5 square meters per gram. Under these conditions, the advantages of the invention can readily be obtained with a ratio of mass of solid phase to mass of gas phase in the mixture which is within the range of 0.25 to 8 approximately. The presence of said particles makes it possible to increase the density of the fluid which nevertheless retains the compressibility of a gas. The invention permits artificial enhancement of mechanical energy transfer processes with respect to heat transfer processes.

Another method of increasing temperature differences between a heat source and a heat sink in the performance of a complete thermodynamic cycle consists in the use of recuperative heat exchangers between the high pressure and low pressure, these heat exchangers being advantageously included within the same rotor of the device in accordance with the invention. In order to transfer the heat recovered by an intermediate circuit, it proves desirable in this case to employ a fluid having a specific heat of much higher value than that of the working fluid. This is intended to constitute a kind of internal heat pump providing natural circulation in the gravitational field; this heat pump automatically extracts from the overall cycle the quantity of utilizable energy which is necessary in order to compensate for friction forces developed within the intermediate circuit and operates with a small temperature difference.

A judicious choice of particular methods for the transfer of utilizable energy between the fluid and the exterior of the rotor makes it possible to ensure a high standard of leak-tightness between the surrounding atmosphere and the working fluid enclosure. A first method of ensuring said leak-tightness which is already known per se consists in making use of a ferromagnetic liquid within a rotating seal.

A second method of ensuring said leak-tightness dispenses with any need for a rotating seal which provides a separation between the surrounding atmosphere and the working fluid. In order to constitute the working fluid itself, a particular alternative embodiment of the invention accordingly consists in utilizing a suspension of ferromagnetic particles in a gas, said fluid being subjected to magnetic fields, the intensity of which varies at absolute value. Said magnetic fields are produced by magnets located externally of the rotor.

In accordance with a preferred alternative embodiment of the invention, a third method of ensuring leak-tightness makes it possible to dispense with any rotating seal between the external atmosphere and a working fluid which does not have any particular magnetic properties. In accordance with this method, the working fluid which undergoes a thermodynamic process in a closed circuit or circulation loop is passed successively through the rotor ducts contemplated by the method in accordance with the invention and through the ducts of another duct which is wholly incorporated in the rotor; this reaction unit is maintained stationary artifically in accordance with a first alternative arrangement or is capable of rotating about the same axis as the rotor but at a different angular velocity and if necessary in the opposite direction in accordance with a second alternative arrangement. In both alternative arrangements, the relative motion of the rotor and of the internal reaction unit makes it possible to convert to work, in one direction or the other, the utilizable energy which is contained in the working fluid.

The particular embodiments which will be described in greater detail by way of example and not in any limiting sense are constructed as shown in the accompanying schematic drawings, wherein.

Figure 2:
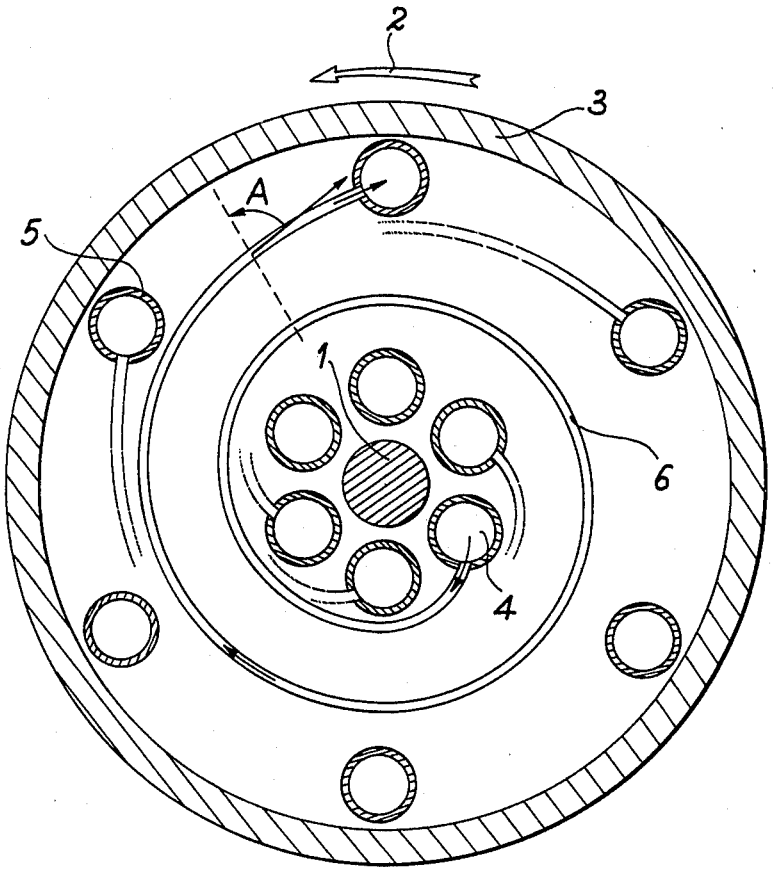
FIG. 2 is a transverse sectional view of the rotor, showing a unitary working fluid duct in a basic device in accordance with the invention, or machine A.

The sectional view of FIG. 2 shows a basic device which operates as a compressor. In the example corresponding to this figure, said device comprises a shaft 1 at the center of the rotor which is driven in rotation in the direction indicated by the arrow 2, a cylindrical casing 3 which surrounds the rotor and to which are transferred the mechanical forces applied to the internal structures by the gravitational field.

The fluid circuit comprises six admission tubes 4 and six collector tubes 5. All the tubes are of large diameter, have axes which are parallel to the axis of the rotor and are arranged symmetrically about said axis. The admission tubes are connected to the collector tubes by means of small-diameter ducts 6 arranged in spirals and intended to constitute the working fluid ducts in accordance with the invention. The angle A considered in the foregoing has been shown in this figure. In the particular case under consideration, said angle is in the vicinity of 86 degrees. The ducts 6 are provided with internal fins extending in the longitudinal direction and placed in continguous rows which are juxtaposed in the axial direction. The points of connection between any one admission tube and different successive rows are relatively displaced from one row to the next in the azimuthal direction in order to facilitate the execution of welded joints. However, the general structure has a symmetry of the order six and is thus dynamically balanced about the axis of rotation. The spirals are described in the direction opposite to the direction of rotation of the rotor when they are followed in a direction away from the axis. In the case under consideration, the distance from the axis to the spirals increases by a quantity equal to six times the external diameter of the ducts in the case of each revolution about the axis in a relative movement with respect to the rotor.

In this particular case, the value of tgA is 16 on an average for this fluid circuit. By way of example, consideration is given to the case in which this device is coupled to a synchronous motor which rotates at a speed of 3000 revolutions per minute and in which it is intended to handle a fluid capacity corresponding to a flow rate of 10 meters per second within the duct; the fluid enters the duct at a distance of 25 centimeters from the axis and leaves the duct at a distance of 50 centimeters, its density being sufficiently high to ensure that the Reynolds number exceeds $10^5$ and the surface roughness of the walls being such that the coefficient f remains constant and equal to 0.6%. A value f tg A ($V/\omega D$) equal on an average to 0.8 is imposed for these conditions by adopting a hydraulic diameter of slightly less than 4 millimeters. This can be achieved by means of a tube having an external diameter of 20 millimeters and an internal diameter of 17 millimeters, provision being made for sixteen internal fins each having a length of 6 millimeters and a width varying between 2.5 millimeters at the base and 1 millimeter at the ends.

With the constructional parameters given above, the rotation of the device at 3000 revolutions per minute produces only a minimum disturbance in the uniformity of velocities and temperatures at the periphery of the fins.

In respect of the same speed of rotation, the rate of flow of fluid can be varied from one-half to double the nominal flow rate by maintaining values of f tg A ($V/\omega D$) which vary between 0.4 and 1.6, with the result that most of the advantages of the present invention can be retained. If the synchronous motor is replaced by a motor having a utilization value which can vary between 1000 and 4000 revolutions per minute, it is also possible to vary the volume rates of flow by a factor which is greater than 12.

By way of alternative, when the device shown in FIG. 2 operates at normal speed with $V=10$ m/s and $\omega=314$ radians per second and when said device is employed as a heat source for delivering heat to water which is circulated around the tubes, it is found that, in the case of a specific heat at constant pressure of the fluid circulated within the tubes which is equal to 300 kilojoules per metric ton and per degree and in respect of a temperature of said fluid which is higher than that of the walls by 4° C., the temperature drop between the duct inlet at a distance of 25 cm from the axis and the duct outlet at a distance of 50 cm from the axis is only 18° C. whereas said temperature drop would be 48° C. in respect of the same velocity of 10 m/s and the same difference of 4° C. with respect to the wall if the rotor were motionless, that is to say if the fluid were not compressed at the same time as it is cooled. In the case of a heat capacity of the mass of fluid contained within the duct which is equal to 0.01 kilojoule per degree and in the case of a mean density of the fluid of 0.1 t/m$^3$, the heat released by the fluid each second is 1.26 kilowatts.

Figure 1:
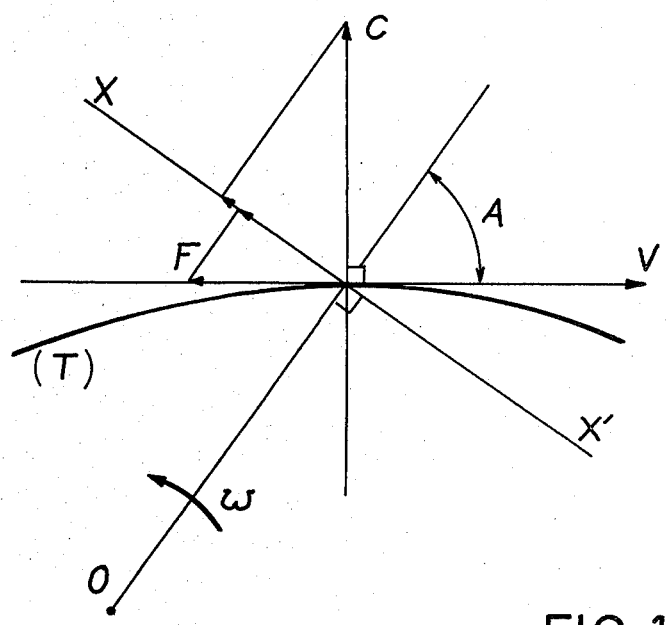
FIG. 1 is a vector diagram of the forces utilized in accordance with the invention.
Figure 5:
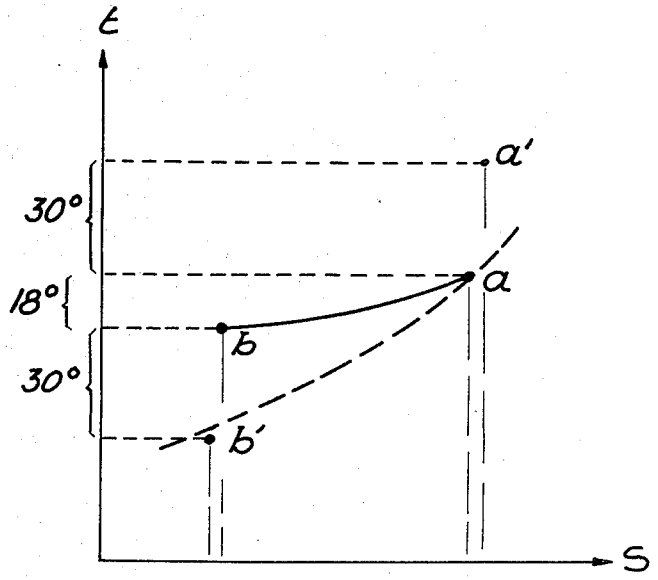
FIGS. 5, 6 and 7 shows the thermodynamic variations of the working fluid in a temperature-entropy diagram, respectively in the case of the machines A, B and C.

The temperature-entropy (tS) diagram of FIG. 5 shows the process path of the fluid between the inlet a and the outlet b. The point a' corresponds to the temperature which would be obtained at the outlet in the case of adiabatic flow, that is to say without circulation of water outside the tubes. The point b' corresponds to the temperature which would be obtained at the outlet with a circulation of water which is adjusted so as to obtain a temperature difference of 4° C. between the fluid and the wall within the stationary rotor. The dashed curve represents an isobaric process. This example clearly shows that the device in accordance with the invention makes it possible to produce any variation in temperature and in enthalpy as a function of the entropy in a practically reversible manner. The speed of rotation of the rotor and the direction of flow of the fluid determine the variation of mechanical energy whilst the temperature difference between the fluid and the wall determines additions or withdrawals of heat. In the case of an adiabatic process, the advantages already noted in the case of operation as a compressor would again be offered in the case of a turbine by reversing the fluid inlets and outlets.

It is also clearly apparent that the requisite conditions for the angle A and the hydraulic diameter D can be satisfied in a wide range of different configurations. The spirals of FIG. 2 can represent schematically ribs which are attached to discs located at right angles to the axis of rotation; they can also represent the intersection with a plane at right angles to the axis of rotation of two profiled sheets which are welded to the two edges and coiled about the axis of rotation while remaining parallel thereto. It is further apparent that all the expedients usually employed for obtaining the desired coefficient f and hydraulic diameter D in heat exchangers can be carried into effect in order to obtain ducts which satisfy the characteristic conditions of the method in accordance with the invention.

The description of the machines B and C which now follows is intended to show by means of examples how the basic device can be incorporated in various machines which utilize closed thermodynamic cycles. The examples chosen are engines but similar arrangements can clearly be adapted to heat pumps.

Figure 3:
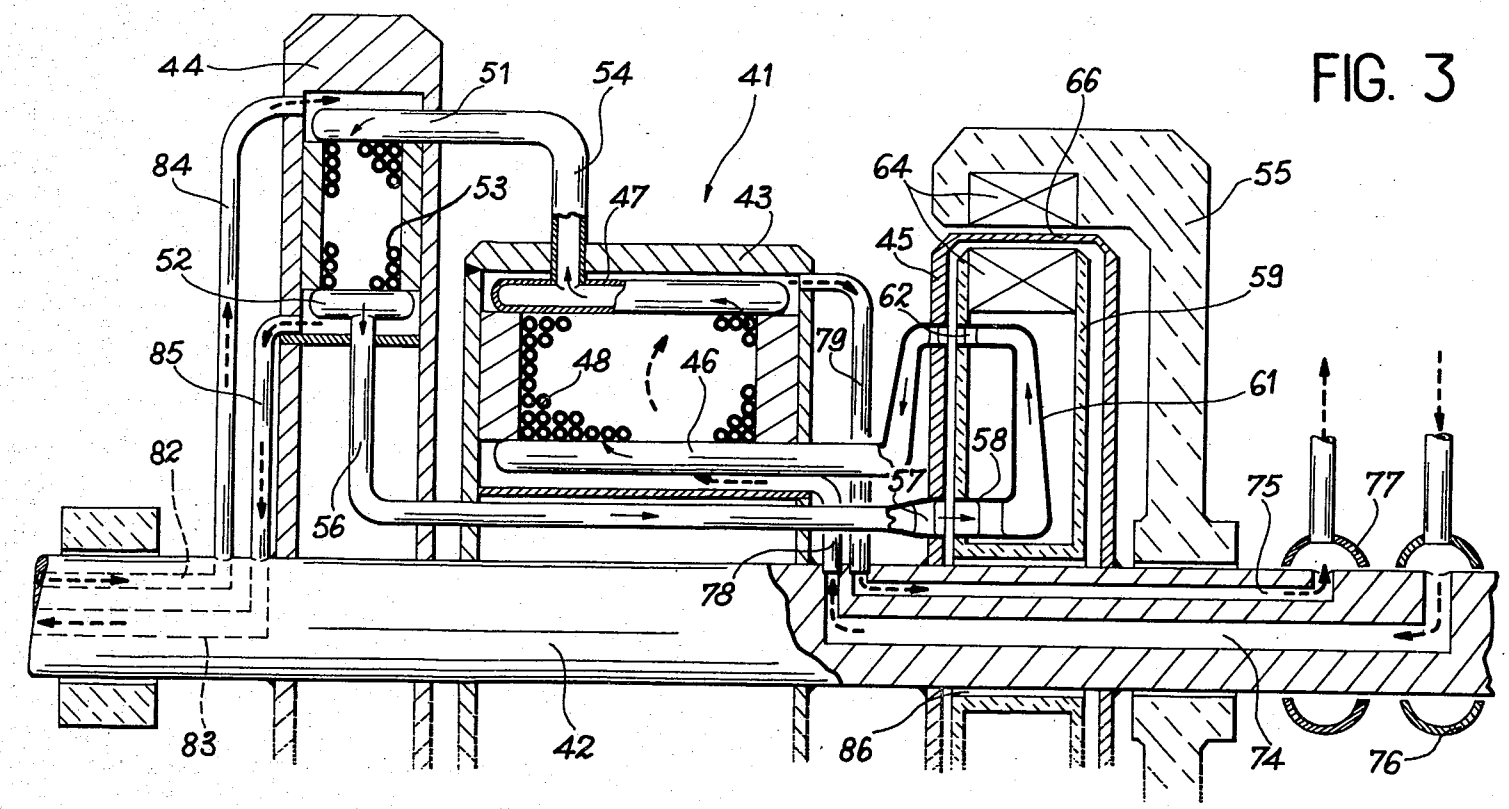
FIG. 3 is a schematic longitudinal sectional view of a machine B in accordance with the invention which constitutes an engine.

The machine B shown in FIG. 3 is an engine in which the working fluid follows a thermodynamic cycle between two heat sources in which it is at different temperatures and in which it exchanges heat with an external auxiliary fluid through the walls of the ducts which control the circulation of said fluid. The heat source is constituted by a pressurized-water circuit and the heat sink is constituted by a water circuit at room temperature. The addition of heat is accompanied by an expansion of the working fluid and the extraction of heat is accompanied by a compression.

Figure 6:
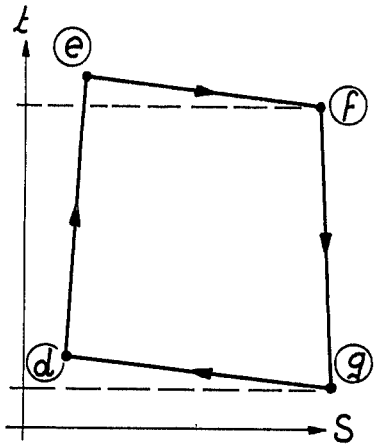

The working fluid circulates through the rotor 41 within a circuit having one portion located within a unit 59 which is entirely incorporated in the rotor but is maintained stationary by magnetic coupling with a fixed support 55 located externally. The working-fluid circuit is thus hermetically closed with respect to the exterior of the rotor. The thermodynamic process is represented by the diagram of FIG. 6 which shows the variations in temperature as a function of the entropy. The cycle consists of an adiabatic compression from (d) to (e), a quasi-isothermal expansion from (e) to (f), an adiabatic expansion from (f) to (g) and a quasi-isothermal recompression from (e) to (d).

The working fluid is krypton and the pressure of this latter within the circuit is several tens of bars at the time of stoppage of the machine. This gas contains a suspension of an equivalent mass of fine particles of tungsten. These tungsten particles have a thickness of the order of one-tenth of a micron and are covered with a monomolecular layer of carbide. The specific heat at constant pressure of the mixture is thus five times lower than that of air and the ratio of specific heats at constant pressure and volume remains fairly high.

The rotor 41 of the machine is capable of rotating at a peripheral velocity within the range of 400 to 500 m/sec. During operation, the rotor drives an alternator for generating electricity which is coupled to the axial shaft 42 of the rotor on the other side of auxiliary fluid connections but which is not illustrated in the figures.

The working-fluid circuit and the auxiliary hot water and cold water circuits are rigidly fixed to said rotor which is made up of three separate frames, namely a cold frame 43, a hot frame 44 and a negative feedback frame 45 which are coupled independently to the axis of rotation in order to reduce thermal stresses. The two heat sources are constituted annularly about the axis of the rotor, the hot source being located at a greater distance from said axis than the cold source, or heat sink.

Within the cold frame 43, the main fluid circuit comprises three admission tubes 46 and three collector tubes 47 of large diameter, the axes of which are parallel to the axis of the rotor and arranged around said rotor on two concentric cylinders. Said admission tubes and collector tubes are interconnected by means of ducts 48 of small diameter in accordance with an arrangement which is similar to that of the basic device of FIG. 2 but with ternary symmetry. The ducts 48 are provided with internal fins and the size of these latter increases with the distance from the axis in such a manner as to ensure that the product of the cross-sectional area for flow and the hydraulic diameter is inversely proportional to the local density of the working fluid. The suspension of tungsten in krypton which constitutes the working fluid circulates within the ducts 48 along spiral flow paths which are so oriented as to rotate about the axis of rotation in a direction opposite to the direction of rotation of the machine, as considered when moving away from the axis. The complete assembly formed by the admission tubes and collectors of the cold section is applied against a mechanical structure which serves to transmit the centrifugal forces to an external cylindrical shell of the frame 43.

Provision is made within the hot frame 44 for three admission tubes 51 and three collector tubes 52 which are similar to those of the cold section but smaller in diameter and placed respectively further away and nearer to the rotor shaft 42. These tubes are connected to each other by means of internally finned ducts 53 having a diameter which is also smaller than those of the cold section. These ducts are arranged in juxtaposed rows and each row is made up of three turns coiled in a plane at right angles to the axis. The spirals are so oriented that the direction considered when moving towards the axis of rotation of the machine is the same as the direction of rotation. The complete assembly constituted by the ducts 53 is applied against a mechanical structure for transmitting the greater part of the centrifugal forces to a shell of substantial thickness which forms part of the frame 44 and surrounds the entire hot zone.

The three collector tubes 47 of the cold zone are connected individually and respectively to the three admission tubes 51 of the hot zone by means of three radial connecting tubes 54. Differential expansions are compensated by the flexural deformation of these radial tubes. The three collector tubes 52 of the hot zone are connected to orifices 57 of the negative feedback zone 45 by means of three connecting tubes 56 each having a radial portion and an axial portion.

These orifices 57 which are disposed annularly in spaced relation are provided with blade systems which are similar to the intake blades of an axial-flow turbine and are located opposite to similar blade systems 58 carried by a stationary unit 59. Said stationary expansion unit comprises ducts 61 of decreasing cross-sectional area which are arranged in spirals oriented in the same direction as the direction of rotation of the rotor and terminate in orifices 62 located further away from the axis of rotation. Said orifices are also fitted with blades and are located opposite to a rotor inlet diffuser.

The stationary unit 59 has an annular shape and is supported on a bearing constituted by the rotor shaft 42 by means of a gas cushion 86 obtained by withdrawing a small flow of working fluid between the orifices 57 and 62 in which the static pressures are different and which separates the stationary section from the moving section while ensuring aerodynamic lubrication. Labyrinth seals (not shown in the figure) separate the two series of orifices 57 and 62. The stationary unit 59 carries part of a magnetic circuit 64, the polarities of which are alternated in the azimuthal direction. Said magnetic circuit is closed across the frame 45 (which has a small thickness within the air-gap 66) within a fixed support designated by the reference 55 and located externally of the rotor.

The auxiliary cold water circuit comprises an admission duct 74 arranged at the center of the rotor shaft, and annular discharge ducts 75 which are connected respectively to annular sealing devices shown diagrammatically in the figure at 76 and 77 and providing a connection with the external network, and to radial tubes 78 and 79 for connecting said discharge ducts to the cold water box which surrounds the ducts 48 of the cold section in accordance with an arrangement which is similar to that of the machine A apart from the fact that, in this case, the water circulates in the same direction as the working fluid.

Admission and discharge of hot water take place in accordance with arrangements which are similar to those of the cold circuit by means of admission ducts 82, discharge ducts 83 and radial connecting ducts 84 and 85. The water circulates within the hot water box around the walls of the working-fluid ducts and towards the axis of the machine. The hot circuit is connected by means of rotating seals and a pump to a pressurization and reheating device comprising burners located externally of the rotor. These devices have not been illustrated in the figures.

The assembly formed by the rotor 41 together with its hot and cold frames 44 and 45 as well as the fixed support 55 are grouped together within an enclosure (not shown in the figure) within which an air pressure below 1 centimeter of mercury is maintained by means of an auxiliary pump and makes it possible to reduce frictional losses on the external wall of the rapidly moving parts.

When the machine B of FIG. 3 is operating, the working fluid follows the thermodynamic cycle of FIG. 6. This fluid is compressed adiabatically within the tubes 54 during its transfer from the cold zone to the hot zone and is heated to 300° C., for example. This conversion is completely adiabatic in the case of a mixture of krypton and tungsten but not to a complete extent in the case of krypton considered separately; the temperature of krypton is very slightly higher than that of tungsten which performs the function of a heat sink. The gravitational field increases the enthalpy per unit mass of the mixture and this results in a considerable increase in density and in pressure.

In spite of the high accelerations, the rate of slippage of tungsten with respect to the gas remains negligible in comparison with the mean rate of flow and turbulent agitation plays a contributory part in homogenizing the mixture. The conversions are therefore close to reversibility.

Within the ducts 53 of the hot zone [(e) to (f)], the mixture transfers to the rotor the mechanical energy corresponding to the variation of the gravitational potential energy. Since the temperature difference between the water and the fluid remains of small value, the fluid leaves the hot section at a temperature which is reduced by about twenty degrees as is the case with the water temperature. During this conversion process, the heat absorbed by the working fluid is equal to the variation of gravitational potential reduced by the variation of enthalpy. At the same time, the density is divided by a high factor; the diameter of the tubes is determined in such a manner as to ensure that the velocity of the fluid with respect to the rotor is of the order of 15 meters/second at the center of the hot zone.

The fluid then undergoes a generally adiabatic expansion, first within the three tubes 56 which are rigidly fixed to the rotor, then within the stationary unit 59 in which its static temperature continues to decrease in favor of an increase in kinetic energy which enables said fluid to return into the rotor at 62 at a different level of gravitational potential. In this expansion zone, the thermodynamic efficiency is at its lowest value but the losses nevertheless remain of the same order of magnitude as in two successive stages of an axial-flow turbine and relate solely to the useful work of the engine. The expansion is completed within the rotor and the fluid passes into the cold zone at a temperature which is slightly higher than the coolant water inlet temperature. Within the ducts 48 of the cold zone, the fluid releases its heat (from (g) to (d)) as it again moves away from the axis and its azimuthal displacement takes place in the direction opposite to the rotation of the rotor. A quantity of mechanical work taken from the rotor is delivered to said fluid and is slightly greater than the quantity of heat transferred to the cold water by reason of the fact that its enthalpy increases by about twenty degrees.

The overall balance of variations in gravitational energy is zero. The rotor exchanges with the stationary unit 59 a quantity of mechanical work equal to the difference in quantities of heat which the working fluid has received from the heat source and delivered to the heat sink.

In the cold water circuit, the variations in density of the water within the gravitational field tend to assist its motion in the required direction and there is no need to provide a feed pump. On the other hand, the hot water circuit calls for the use of a small auxiliary pump (not shown in the figure) since the density within the gravitational field decreases between the inlet and the outlet.

The power of the motor is controlled by the rate of flow of the hot water stream by means of a valve placed in the auxiliary pump circuit.

Figure 4:
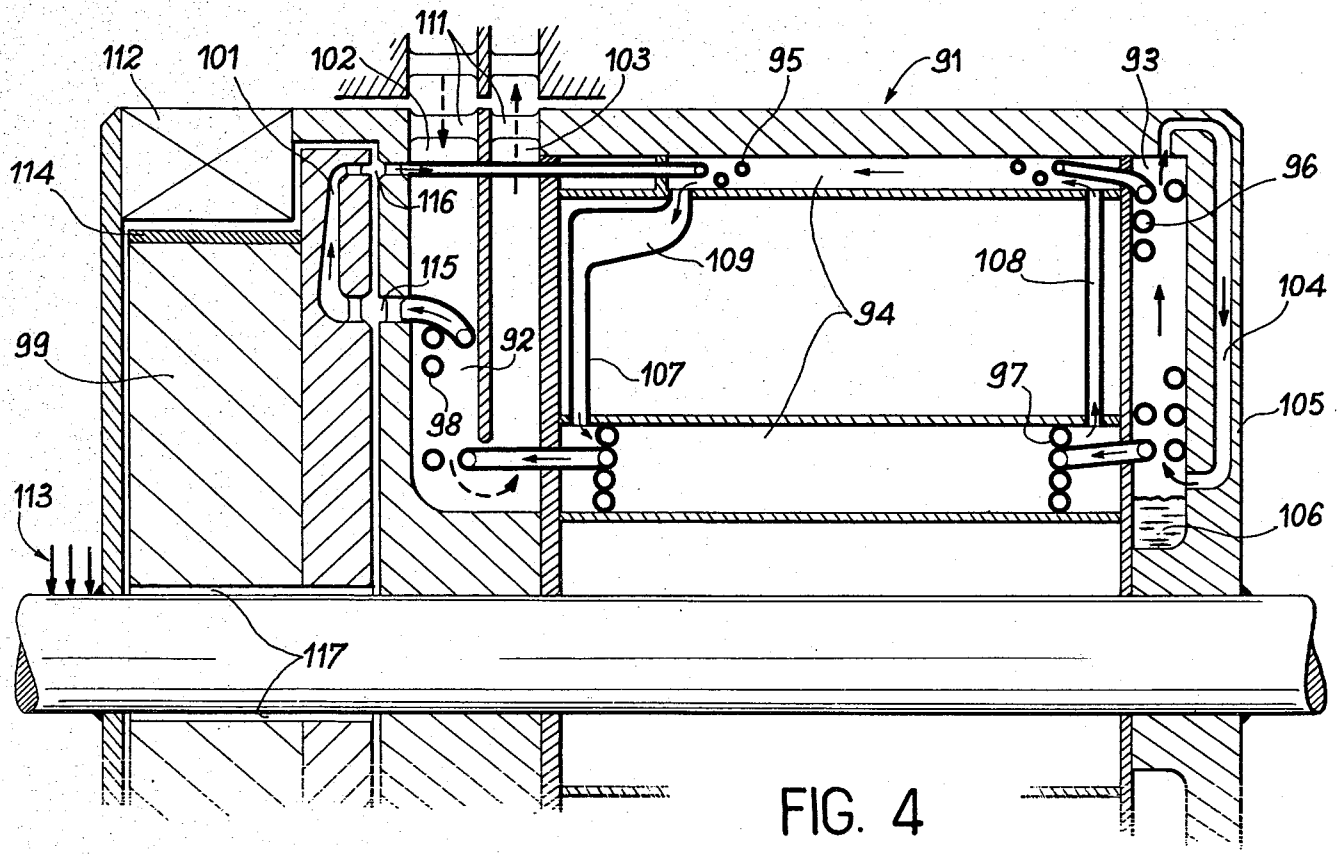
FIG. 4 is a schematic longitudinal sectional view of a third alternative embodiment of the invention in which a machine C is an intermediate recuperation engine which operates with two practically isothermal heat sources.

The machine C which is illustrated in FIG. 4 is an engine which operates between two practically isothermal sources and makes use of an intermediate recuperator. The heat is supplied to the rotor by radiation at a temperature in the vicinity of 600° C. and the heat sink is cooled by a circulation of atmospheric air. An aerodynamic reaction unit 99 is incorporated in the rotor.

Figure 7:
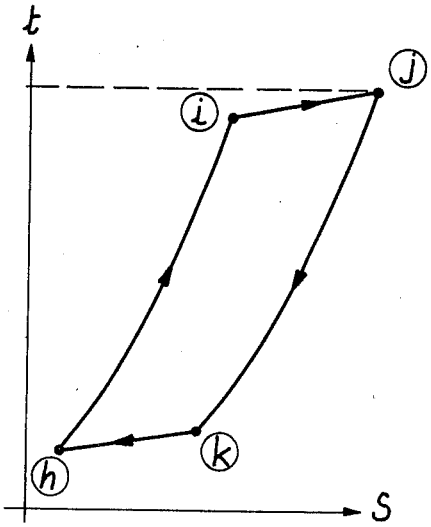

The working fluid is xenon, the pressure of which is several tens of bars at the time of stoppage of the machine; this fluid follows a thermodynamic cycle as shown diagrammatically in FIG. 7 which indicates the variations in the temperature (t) as a function of the entropy (S). The fluid absorbs the recuperation heat between (h) and (i), undergoes expansion within the heat source between (i) and (j), restitutes the recuperation heat between (j) and (k) and is recompressed in the heat sink between (k) and (h). In the machine C, the expansion takes place within the reaction unit 99 which rotates within the interior of the rotor 91 but in the opposite direction. The rotor 91 contains the heat sink 92 and the heat source 93 on each side of the recuperator 94.

Within said rotor 91, the working-fluid circuit comprises successively the peripheral tubes 95 of the recuperator 94 which describe axial helices from one end of the recuperator to the other in the longitudinal direction, the spiral tubes or ducts 96 of the heat source 93, the helical tubes 97 of the internal zone of the recuperator 94, the spiral tubes or ducts 98 of the heat sink 92.

The circuit then passes into the interior of a unit 99 which is similar to that of the machine B and is capable of moving in rotation about the same axis as the rotor 91 but independently of this latter. Within said unit, the circuit is closed by nozzles 101 connected to the ducts of the rotor 91 through annular chambers provided with axial blades. The nozzles under consideration are convergent nozzles coiled around the axis of the machine in spirals, the direction of orientation of said spirals away from the axis being the same as the direction of rotation of the rotor.

The coolant air circuit within the heat sink 92 passes through blades which are parallel to the axis of the rotor and designated by the reference 111, said blades being attached to the periphery of the rotor opposite to stationary inlet and outlet diffusers. The air passes at 102 along spiral paths between the ducts 98 of the heat sink which are provided with highly developed external fins. The air then flows radially away from the axis and finally passes out of the rotor at 103.

The auxiliary fluid employed in the heat source 93 is the eutectic compound NaK which circulates within ducts 104 located in the vicinity of a radial surface 105 of the rotor which is heated by radiation, then between the pipes 96 of the main circuit. An expansion chamber containing argon is provided at 106.

The auxiliary fluid of the recuperator circuit is helium under high pressure containing a suspension of submicronic particles of graphite. The auxiliary fluid circuit comprises radial tubes 107 and 108 so as to provide a passage from an external annular chamber containing the tubes 95 to an internal annular chamber containing the tubes 97, respectively in the outgoing direction and in the return direction. In the outgoing direction, the auxiliary fluid passes through a chamber 109, the inlet and the outlet of which are relatively displaced in the azimuthal; direction at the moment of start-up of the machine, this makes its possible by inertial effect to obtain a movement which initiates the circulation of said auxiliary fluid in the desired direction.

It can be noted that the air circuit has an expansion phase with addition of heat, which plays a part in reducing the quantity of mechanical energy delivered thereto by the rotor for the purpose of maintaining its circulation in opposition to the gravitational field (since its density decreases) and to friction forces. The fins 111 of the inlet and outlet diffusers provide the air with the complementary energy which is necessary for it motion.

The NaK circuit is not equipped with a pump but operates spontaneously by natural circulation since the ducts 104 are so arranged that the radiation heating zone is located slightly further away from the axis of rotation than the zone for cooling said auxiliary fluid which is in contact with the walls of the ducts 96.

The helium circuit also operates as a heat pump in a closed circuit within the gravitational field of the rotor 91. The mean temperature difference between the internal tubes 97 and the peripheral tubes 95 of the recuperator circuit is greater than the temperature difference corresponding to adiabatic equilibrium of the helium and graphite mixture within the gravitational field and the circulation takes place naturally. In order to initiate circulation in the appropriate direction, the orifices of the helium duct within the chamber 109 are set back with respect to each other in the azimuthal direction as already indicated in the foregoing.

FIG. 7 shows the process path followed by the working fluid, the stationary-state temperature with respect to the rotor 91 being adopted as a reference. Between the rotor outlet and the rotor inlet, the working fluid undergoes adiabatic expansion within the convergent nozzles 101 while increasing its kinetic energy. The difference between gravitational energies determines the quantity of utilizable energy released by the relative motion of the rotor and of the internal moving unit 99.

The power of the engine is controlled by means of the radiation flux which arrives on the face 105 of the rotor. In the particular case herein described, the energy released by the action of the fluid on the rotor 91 and the unit 99 is utilized in an electric generator which is shown in the left-hand portion of the machine of FIG. 4.

The generator under consideration is of the asynchronous type, the three-phase armature windings 112 of the generator being fixed on the rotor which is intended to rotate in the direction opposite to the unit 99. There are shown diagrammatically at 113 three electrical contacts which are fixed at the shaft of the rotor 91 and connect each winding 112 respectively to an external three-phase circuit in which the system delivers active energy. The moving unit 99 is not provided with an electrical winding but only with conductors 114 located at the periphery and parallel to the axis, said conductors being short-circuited at their extremities (in a so-called squirrel-cage system of connection). Said unit is not provided with any internal recesses and its moment of inertia is close to that of the rotor 91.

Although not shown in the drawings, it is worthy of note that the supply of the aerodynamic bearing 117 and the cooling of the electric circuit are ensured by withdrawal of the working fluid from a by-pass across its coldest portion between 115 and 116.

It is pointed out that the invention is not limited in any sense to the particular machines which have been described by way of example. Consideration will now be given more specifically to a certain number of distinctive features of the invention which these machines are intended to illustrate.

In machines in accordance with the invention, the fluid ducts can be constituted in particular by finned tubes which describe Archimedes' spirals and which are connected in parallel with the fluid circuit in a symmetry of revolution of ternary order at a minimum. The working fluid can circulate either within the interior or externally of said tubes.

In order that all conversions can take place within a single rotor in the case of an engine or heat pump which operates in a closed cycle, use can be made of a ferromagnetic fluid. As a rule, however, the fluid must pass within the rotor and within a stationary unit, or within the rotor and within a unit which rotates at a different speed.

In order to solve problems of leak-tightness, one possible expedient (machine B) consists in passing the working fluid through an accelerating or slowing-down enclosure which is located within the walls of the rotor but remains stationary with respect to the exterior, the transmission of forces which are necessary in order to compensate for the driving or resisting torque of the machine being ensured by means of a magnetic coupling. Another possible expedient (machine C) consists in passing the fluid from a first rotor to a second rotor. Said second rotor is entirely located within the interior of the first, has a moment of inertia which is comparable to said first rotor and rotates in the opposite direction. The torque exerted by the two contrarotating rotors on each other is balanced by magnetic forces applied to electric windings which perform the function of armature or field winding. These electromagnetic circuits serve to extract the utilizable energy from the working fluid or on the contrary to impart mechanical energy thereto by means of the electrical energy which passes into the main rotor by means of rotary contacts.

Among the main advantages of the invention, the following are particularly worthy of note:

- the utilization of thermodynamic cycles having high efficiencies by virtue of practically isothermal processes without any change of state;
- a reduction of degradations of energy in any thermodynamic conversion processes;
- the use of solid suspensions for heat transfers or energy conversions;
- the simplicity of design of a novel type of pumps, compressors or turbines;
- the suppression of cavitation problems in pumps and erosion problems in turbines;
- the reduction of noise of turbo-machines;
- a wider range of possibilities of choice in regard to the properties of the working fluid and in regard to the arrangement of the different elements in all types of heat engines and machines;

the integration of a number of thermodynamic conversions within a single unit of simple design.

As can naturally be understood, the scope of this patent is not limited to the particular features and preferred arrangements mentioned within the area of application of the machines which have been described in detail. For example, the flat spirals constitute only one particular case of variable-azimuth ducts. The spirals could be replaced by curves which have the shapes of flat spirals in projection at right angles to the axis but extend in volume in a direction parallel to the axis. All alternative forms of the ducts aforesaid as well as all alternative designs of the various elements of the devices and machines hereinabove described also form part of the present invention. Furthermore, the invention extends to many alternative forms of the methods hereinabove described. For example, it applies to methods in which the working fluid undergoes changes of phase by evaporation or condensation within ducts in which the fluid circulates at relatively low rates of flow.

What is claimed is:

1. A method of energy conversion involving at least one step of compression or expansion of a working fluid within a rotor, wherein said method comprises: circulating the working fluid within a duct which is rigidly fixed to the rotor and follows a circuit having the shape of a spiral, said spiral being oriented in such a manner as to draw nearer to the axis of rotation of the rotor as it is followed around said axis in the direction of rotation of the rotor and wherein the geometrical characteristics of the duct are determined in conjunction with the operating conditions in such a manner as to ensure that the ratio of the azimuthal projection of the friction force exerted on the fluid by the duct walls and the azimuthal projection of the Coriolis force to which the fluid is subjected are in the range of 0.2 to 2.

2. A method according to claim 1 wherein, at each point of the duct, the angular velocity $\omega$ of the rotor, the relative velocity $\overline{V}$ of the fluid within the duct, the hydraulic diameter D of the duct, the coefficient of friction f of the fluid on the walls of the duct and the angle A made with the meridian plane at the point considered by the plane parallel to the axis of the rotor defined by the direction of the circuit at this point satisfy the following condition during operation:

$$0.2 \leqq (f\,\overline{V}/\omega D)\ \mathrm{tg}\ A \leqq 2.$$

3. A method of energy conversion involving at least one step of compression or expansion of a working fluid which circulates within a rotor and follows a thermodynamic cycle, wherein the working fluid is circulated within a duct constituted in the manner defined in claim 1 or claim 2 and in the corresponding conditions, and wherein the duct constitutes over at least a fraction of said circuit a heat source or a heat sink in which the heat is added to the working fluid or withdrawn therefrom.

4. A method of energy conversion involving the circulation of a working fluid along a spiral circuit within a rotating rotor, the working fluid following a thermodynamic cycle between a heat source and a heat sink, wherein a gas having a low value of specific heat is employed for constituting the working fluid and contains in suspension submicronic particles of a substance having an atomic weight of greater than 90.

5. A method according to claim 4, wherein the gas is selected from nitrogen, argon, krypton and the substance having an atomic weight of greater than 90 is selected from tungsten, lead, busmuth, thorium, uranium.

6. A device for the compression or expansion of a working fluid, comprising: a rotatable rotor having a predetermined direction of rotation, means forming working-fluid ducts in the rotor defining a spiral circuit including a heat source and a heat sink disposed at different distances from the rotor axis, a unit including ducts mounted for relative movement with respect to the rotor about the rotor axis, means for circulating the working fluid in a closed circuit successively in said rotor ducts and in the ducts of the unit and coupling means between said rotor and said unit which is independent of the working fluid and comprises means for converting part of the utilizable energy into mechanical energy.

7. A device according to claim 6, wherein said means comprises tubular heat-transfer walls defining at least a portion of said ducts and further comprising means for circulating a working fluid and an auxiliary fluid respectively on each side of said walls.

8. A device according to claim 6, wherein said ducts comprise Archimedes' spiral tubes which are connected in parallel in the fluid circuit and with a symmetry of revolution of ternary order at a minimum.

9. A device according to claim 6, wherein the heat source is located at a greater distance from the axis than the heat sink.

10. A method of energy conversion involving at least one step of compression or expansion of a working fluid within a rotor, wherein said method comprises circulating the working fluid within a duct which is rigidly fixed to the rotor and follows a circuit having the shape of a spiral, said spiral being oriented in such a manner as to draw nearer to the axis of rotation of the rotor as it is followed around said axis in the direction of rotation of the rotor and wherein, at each point of the duct, the angular velocity $\omega$ of rotor, the relative velocity $\overline{V}$ of the fluid within the duct, the hydraulic diameter D of the duct, the coefficient of friction f of the fluid on the walls of the duct and the angle A made with the meridian plane at the point considered by the plane parallel to the axis of the rotor defined by the direction of the circuit at this point satisfy the following condition during operation:

$$0.2 \leqq (f\,\overline{V}/\omega D)\ \mathrm{tg}\ A \leqq 2.$$

11. A method of energy conversion involving at least one step of compression or expansion of a working fluid which circulates within a rotor and follows a thermodynamic cycle, wherein the working fluid is circulated within a duct constituted in the manner defined in claim 10 in the corresponding condition, and wherein the duct constitutes over at least a fraction of said circuit a heat source or a sink in which the heat is added to the working fluid or withdrawn therefrom.

12. A method of energy conversion according to claim 10, wherein a gas having a low value of specific heat is employed for constituting the working fluid and contains in suspension submicronic particles of a substance having a high atomic weight.

13. A method according to claim 12, wherein the gas is selected from nitrogen, argon, krypton and the substance having a high atomic weight is selected from tungsten, lead, bismuth, thorium, uranium.

* * * * *

UNITED STATES PATENT AND TRADEMARK OFFICE

CERTIFICATE OF CORRECTION

PATENT NO. : 4,285,202

DATED : Aug. 25, 1981

INVENTOR(S) : Bernard Bailly du Bois

It is certified that error appears in the above-identified patent and that said Letters Patent are hereby corrected as shown below:

| | |
|---|---|
| Title Page Priority | Insert --France No. 7731551 filed October 20, 1977--. |

Signed and Sealed this

*Twenty-first* Day of *September 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,285,202

DATED : August 25, 1981

INVENTOR(S) : Bernard Bailly du Bois

It is certified that error appears in the above-identified patent and that said Letters Patent is hereby corrected as shown below:

On the title page the following should be added:

-- [30] Foreign Application Priority Data

Oct. 20, 1977 France 77 31551 --.

Signed and Sealed this

Thirtieth Day of November 1982

[SEAL]

*Attest:*

GERALD J. MOSSINGHOFF

*Attesting Officer*

*Commissioner of Patents and Trademarks*